US010435195B2

(12) United States Patent
Wallace

(10) Patent No.: US 10,435,195 B2
(45) Date of Patent: Oct. 8, 2019

(54) REINFORCED GAYLORD CONTAINER

(71) Applicant: Converter Manufacturing, LLC, Orwigsburg, PA (US)

(72) Inventor: Millard F. Wallace, Orwigsburg, PA (US)

(73) Assignee: Converter Manufacturing, LLC, Orwigsburg, PA (US)

( * ) Notice: Subject to any disclaimer, the term of this patent is extended or adjusted under 35 U.S.C. 154(b) by 107 days.

(21) Appl. No.: 15/672,537

(22) Filed: Aug. 9, 2017

(65) Prior Publication Data

US 2019/0047742 A1 Feb. 14, 2019

(51) Int. Cl.

| | |
|---|---|
| ***B65D 5/44*** | (2006.01) |
| ***B65D 19/00*** | (2006.01) |
| ***B65D 5/00*** | (2006.01) |
| ***B65D 43/02*** | (2006.01) |

(52) U.S. Cl.

CPC ..... *B65D 5/445* (2013.01); *B65D 5/005* (2013.01); *B65D 19/0048* (2013.01); *B65D 43/0222* (2013.01)

(58) Field of Classification Search

CPC ..... B65D 5/00; B65D 5/005; B65D 5/006; B65D 5/44; B65D 5/445; B65D 19/00; B65D 19/0048; B65D 43/02; B65D 43/0222

See application file for complete search history.

(56) References Cited

U.S. PATENT DOCUMENTS

| | | | | |
|---|---|---|---|---|
| 2,443,684 | A * | 6/1948 | Lazarus | B65D 19/44 206/386 |
| 2,943,732 | A | 7/1960 | Kovaleski et al. | |
| 4,580,680 | A | 4/1986 | Wind | |
| 4,998,619 | A | 3/1991 | Sowa et al. | |
| 5,163,556 | A | 11/1992 | Akao et al. | |
| 5,201,421 | A * | 4/1993 | Maier | B65D 19/44 206/600 |
| 5,344,014 | A | 9/1994 | Toral et al. | |
| 5,415,289 | A | 5/1995 | Kim | |
| 5,421,537 | A | 6/1995 | Cobane et al. | |
| 5,501,351 | A | 3/1996 | Niles et al. | |
| 5,607,052 | A | 3/1997 | Liepold et al. | |
| 5,618,153 | A * | 4/1997 | Lindgren | B65D 19/38 206/386 |
| 6,827,217 | B2 | 12/2004 | Matsuguchi et al. | |
| 7,066,342 | B2 * | 6/2006 | Baechle | B65D 5/006 206/600 |
| 7,124,889 | B2 | 10/2006 | Fuemmeler | |
| 7,476,068 | B2 * | 1/2009 | Lau | B65D 15/22 206/386 |
| 9,783,333 | B1 * | 10/2017 | De Los Santos | B65D 5/006 |
| 2003/0010663 | A1 | 7/2003 | Barton et al. | |
| 2004/0007487 | A1 | 1/2004 | Cantu-Gonzalez | |
| 2006/0196794 | A1 | 9/2006 | Nicklas | |

(Continued)

*Primary Examiner* — Bryon P Gehman

(74) *Attorney, Agent, or Firm* — Ryan W. O'Donnell; Volpe and Koenig P.C.

(57) ABSTRACT

A reinforced Gaylord container is provided storage and transport, including stacked storage on a pallet. A core is provided for supporting a majority of a vertical load on the container, instead of such load being delivered to sidewalls. A positioning insert is provided for positioning the core within the container. A plurality of such containers may be placed on respective pallets and stacked.

19 Claims, 6 Drawing Sheets

(56) References Cited

U.S. PATENT DOCUMENTS

| | | | |
|---|---|---|---|
| 2007/0277707 | A1 | 12/2007 | Robbins |
| 2014/0054292 | A1 | 2/2014 | Wallce |
| 2017/0043974 | A1 | 2/2017 | Moore |
| 2017/0165896 | A1 | 6/2017 | Wallace |

* cited by examiner

REINFORCED GAYLORD CONTAINER

FIELD OF INVENTION

The subject matter of the present application pertains to the field of Gaylord containers. It is particularly related to a Gaylord container reinforced by a core and a positioning insert, positioned within the Gaylord container for supporting vertical loads.

BACKGROUND

A Gaylord container, also known as a bulk box, bulk bin, bin box, skid box, or pallet box or container, is used for the storage and transport of a variety of products. Gaylord containers are made of corrugated fiberboard, and a typical Gaylord container can only support a limited number of additional stacked pallet containers, unless reinforcement is provided. For example, in known conventional containers without reinforcement, the sidewalls or shroud of the container typically supports any containers stacked above the container. Conventional shrouds typically support approximately 150 lbs of stacked weight. Such conventional containers can be reinforced to support additional stacked weight by, for example, using a thicker material for sidewalls, diagonal struts, or the like. However, these various solutions significantly increase cost and weight while not being removable or customizable. Moreover, octagonal containers are known to provide improved stacking, but reduce the container volume as compared to a rectangular shape.

The present disclosure is directed to overcoming one or more problems of the prior art, including cost, weight, difficulty of assembly, limited stacking capacity, etc. At the same time, the present disclosure is directed to providing an improved reinforcement for Gaylord containers that may be easily removed or reconfigured for various purposes. The present disclosure is particularly applicable to Gaylord containers used in storing and transporting trays and containers for the food industry.

SUMMARY

In one aspect, the present disclosure is directed to a container for pallet-based storage and transport. The container includes a bottom wall, a top wall, a plurality of side walls, a core, and a positioning device. The bottom wall defines a length and a width of the container. The plurality of side walls forms an enclosure between the bottom wall and the top wall. The core extends from adjacent the bottom wall to adjacent the top wall. The positioning insert is configured to center the core along the length and the width of the container. The positioning insert abuts at least two side walls of the plurality of side walls. The core is configured to transfer substantially all of a vertical load on the top wall to the bottom wall.

In another aspect, the present disclosure is directed to a pallet storage system. The system includes a first pallet and a first container. The first pallet includes a plurality of runners and a plurality of ribs perpendicular to the runners. The first pallet defines a length and a width. The first container includes a bottom, sidewalls, a top, and a core extending from the bottom to the top. The container has a length and a width approximately equal to the first pallet. The core is centered along the length and the width of the container. The core is aligned with a center rib of the plurality of ribs and aligned with a center runner of the plurality of runners.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

Figure 1:
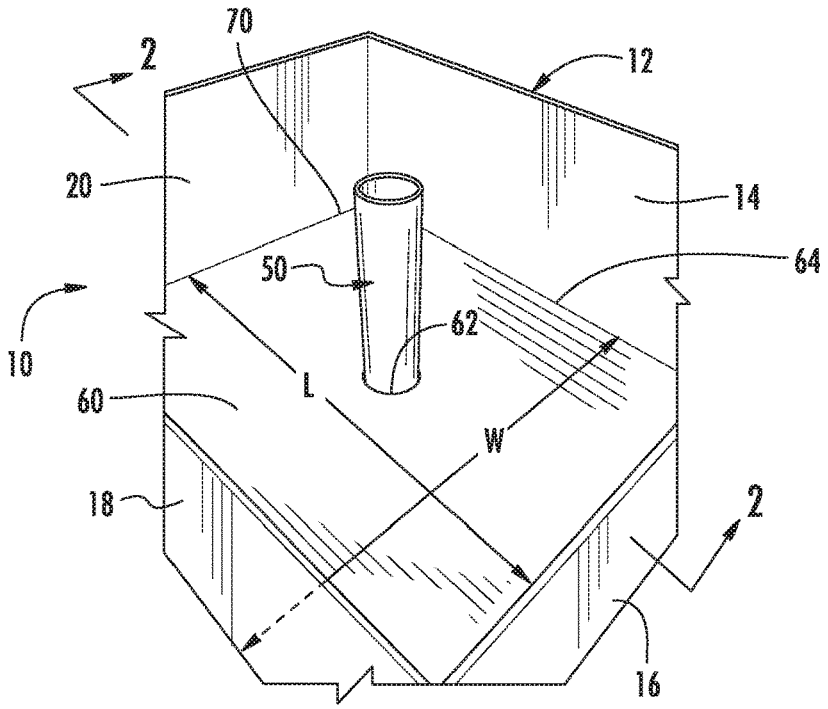
FIG. 1 is a partial perspective view of a container according to an embodiment of the present invention.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted. The phrase "at least one" followed by a list of two or more items (such as A, B, or C) means any individual one of A, B or C as well as any combination thereof. The term "substantially" means within about ±5% of a given value.

At the outset, it is understood that this invention is not limited only to the particular embodiments, methodology, materials, and modifications described herein, and as such may vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the following example methods, devices, and materials are now described.

Figure 2:
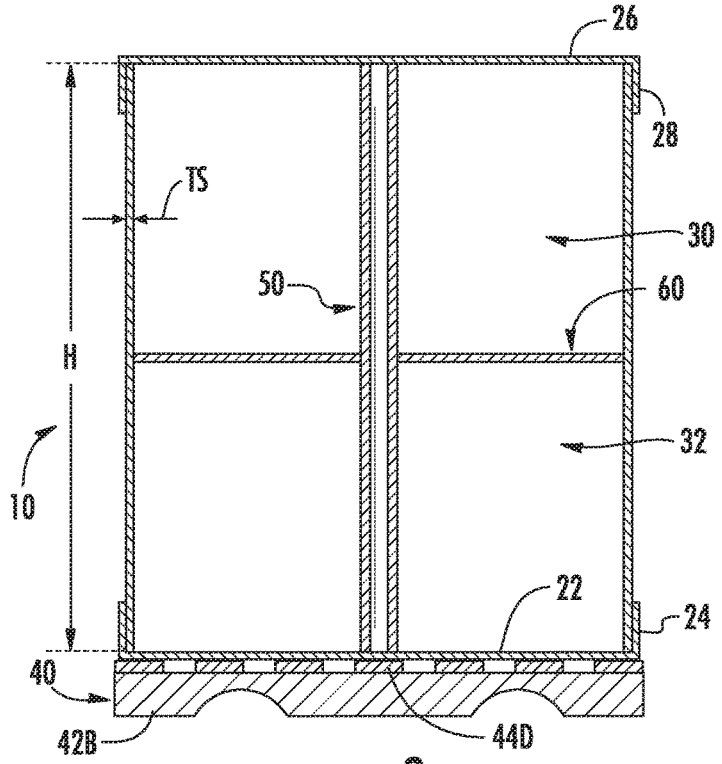
FIG. 2 is a side cross-sectional view of the container of FIG. 1 taken along the line 2-2.

FIGS. 1-2 show an exemplary embodiment of a reinforced Gaylord container 10 having a shroud 12 comprised of sidewalls 14-20. The container also includes a bottom wall 22, also known as a bottom cap or a bottom cover, having a flange 24 and a top wall 26, also known as a lid, top cap, or top cover, also having a flange 28. The exemplary container 10 is a cuboid, and in some embodiments, can be a rectangular cuboid having a length L greater than a width W, and the sidewalls 14-20 defining a height H. The container 10 is sized to be positioned on a standard pallet 40, as further discussed below. In one embodiment, the container 10 may have a length of about 48 inches, a width of about 40 inches, and a height of about 41 inches.

Figure 3:
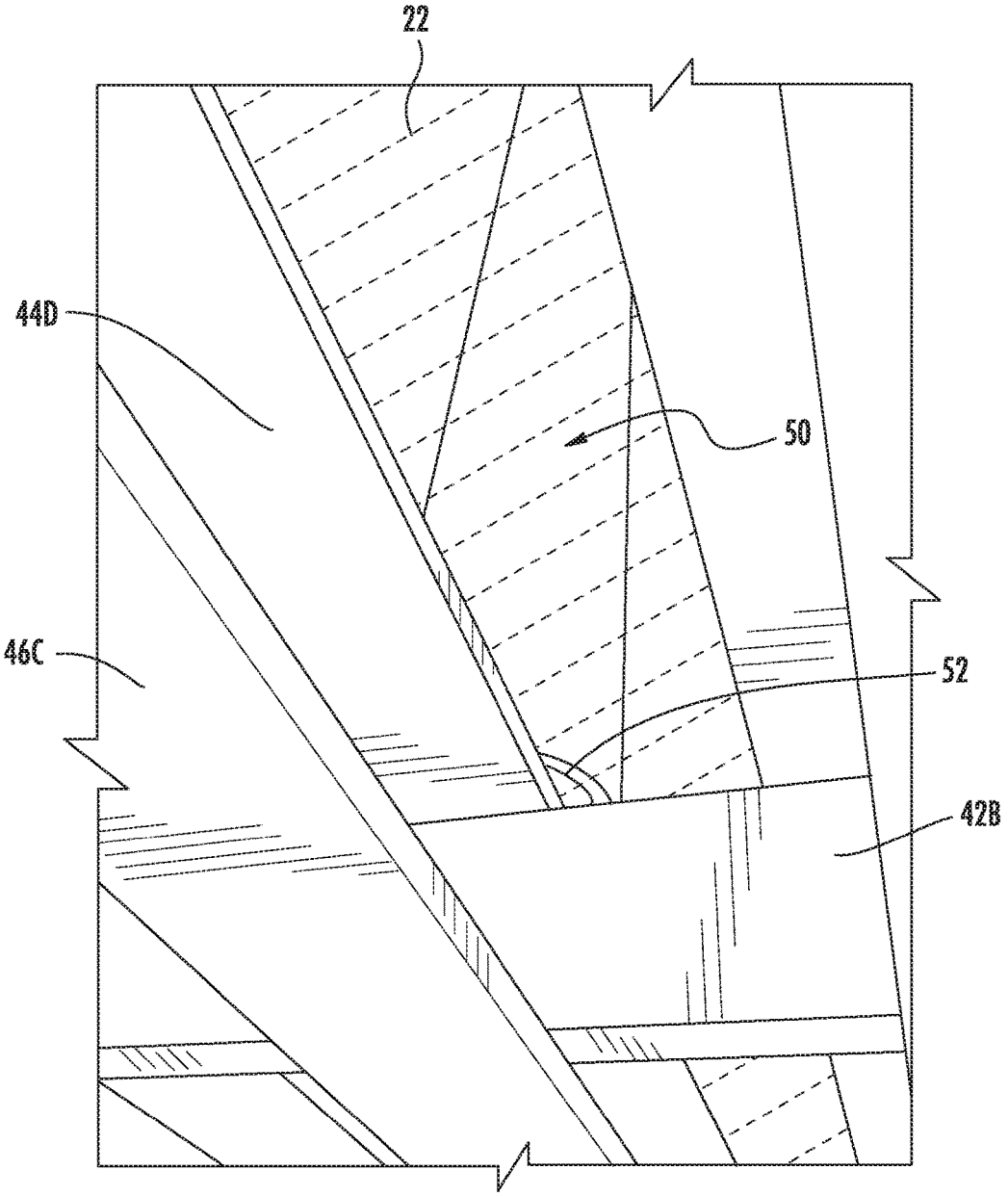
FIG. 3 is a bottom perspective view of the container of FIG. 1 on a pallet with a bottom wall of the container in relief.
Figure 4:
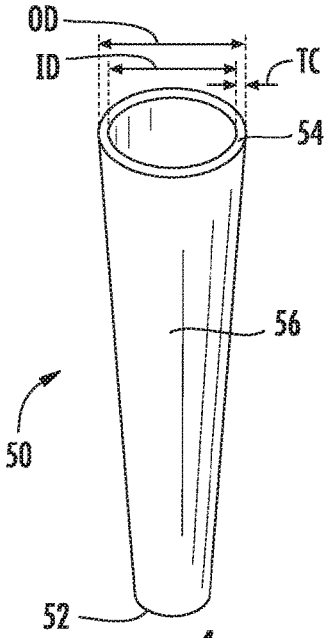
FIG. 4 is a perspective view of the core shown in FIG. 1.

A core 50 is used to structurally reinforce the container 10. The illustrated core 50 is a cylinder with an inner diameter ID, and outer diameter OD, and a thickness TC. Other cross-sectional shapes are contemplated, including, for example, triangle, square, pentagon, and hexagon. As shown in FIG. 3, the core 50 extends from a bottom end 52 to a top end 54 with a sidewall 56 extending therebetween.

The outer diameter OD of the core 50 may be between about 2 inches and about 10 inches, more preferably about 3 inches to about 6 inches, and most preferably about 4.5 inches. In one embodiment, the outer diameter OD of the core 50 is about 4.5 inches and the inner diameter ID is about 4.0 inches, resulting in a core thickness TC of about 0.5 inches. Preferably, when the core 50 is formed of cardboard with an outer diameter OD of about 4.5 inches, it supports a load of up to 3,500 pounds.

Turning again to FIG. 2, the core 50 has a height that is substantially the same as the height H of the sidewalls 14-20. The core 50 may have a slightly greater height than the sidewalls 14-20. For example, the core 50 may have a height that is about 1% to about 10% greater than the side walls 14-20. As a result during use, any weight pressed upon the top wall 26 of the container is transferred to the core 50 instead of the sidewalls 14-20. In an embodiment, preferably at least 90% of the weight pressed upon the top wall 26 of the container is transferred to the core 50 instead of the side walls 14-20. In another embodiment, preferably at least 95% of the weight pressed upon the top wall 26 of the container is transferred to the core 50 instead of the side walls 14-20. In another embodiment, preferably substantially all of the weight pressed upon the top wall 26 of the container is transferred to the core 50 instead of the side walls 14-20.

A positioning insert 60 or card is inserted between the core 50 and spans between at least two of the sidewalls 14-20. The positioning insert 60 serves to align the core 50 within the container. In an embodiment, the positioning insert 60 aligns the core such that it is centered along the bottom wall 22 and/or top wall or lid 26. The positioning insert 60 may also serve to divide the container 10 into an upper compartment 30 and a lower compartment 32.

In a preferred embodiment, an opening 62 in the positioning insert 60 may have a diameter that is substantially equal to the outer diameter OD of the core 50 such that the positioning insert 60 frictionally engages the core. In other embodiments, the opening 62 in the positioning insert 60 is sized to loosely circumscribe the core 50 without positive engagement. The positioning insert 60 has at least two outer edges 64, 66, 68, 70.

Figure 9A:
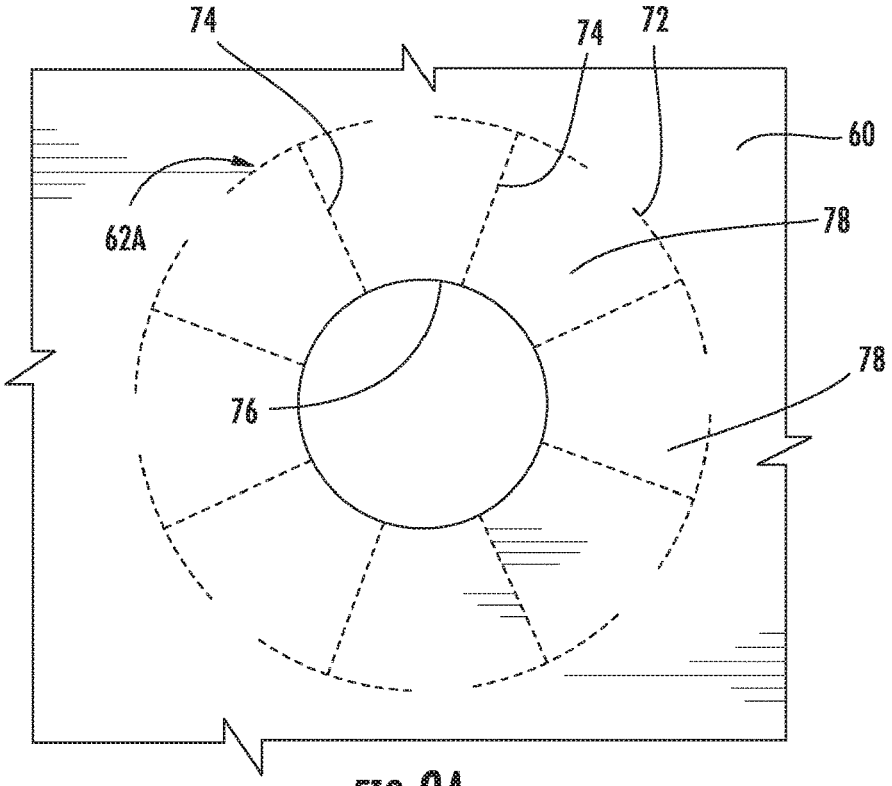
FIG. 9A is a top plan view of an alternative embodiment of an opening of a positioning insert.
Figure 9B:
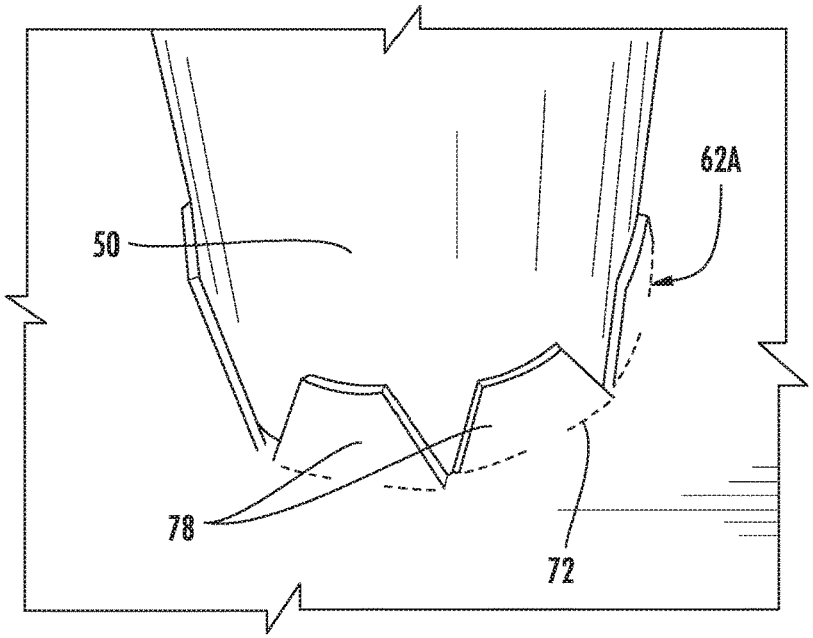
FIG. 9B is a bottom perspective view of the opening of FIG. 9A with a core.

In one preferred embodiment shown in FIGS. 9A and 9B, an opening 62A with starburst perforations is provided for improved engagement with the core 50. The opening has a perimeter perforation 72 and a plurality of radial perforations 74 that terminate at an inner opening 76. A plurality of flaps 78 are positioned between the radial perforations 74. During use, the radial perforations 74 are separated, allowing the flaps 78 to fold along the perimeter perforation 72. In this manner, sufficient space is created for the core 50 and the flaps 78 engage the core 50 frictionally and/or resiliently. Moreover, the opening 62A can readily accommodate and hold different cores 50 with a range of outer diameters OD.

Figure 5A:
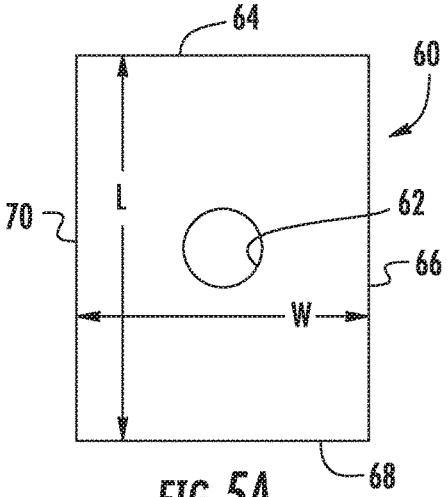
FIG. 5A is a top plan view of the positioning insert shown in FIG. 1.

As shown in FIGS. 1 and 5A, the positioning insert 60 has a length and width that are substantially equal to the length L and width W of the container 10 so as to frictionally engage two or more of the sidewalls 14-20. In this manner, the positioning insert 60 may completely isolate and seal off the upper compartment 30 from the lower compartment 32. In other embodiments, the positioning insert 60 loosely fits within the container 10 without positive engagement due to a length and width that are slightly less than the length L and width W of the container. As a result during use, any lateral or tipping forces on the core 50 will cause the positioning insert 60 to abut at least one of the sidewalls 14-20 and maintain the core 50 in vertical alignment.

Figure 5B:
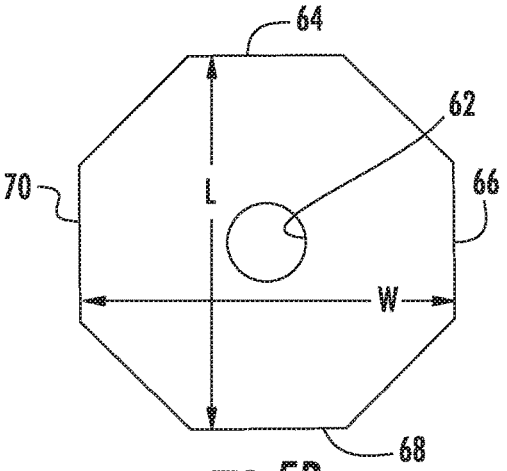
FIG. 5B is a top plan view of an alternative embodiment of a positioning insert.
Figure 5C:
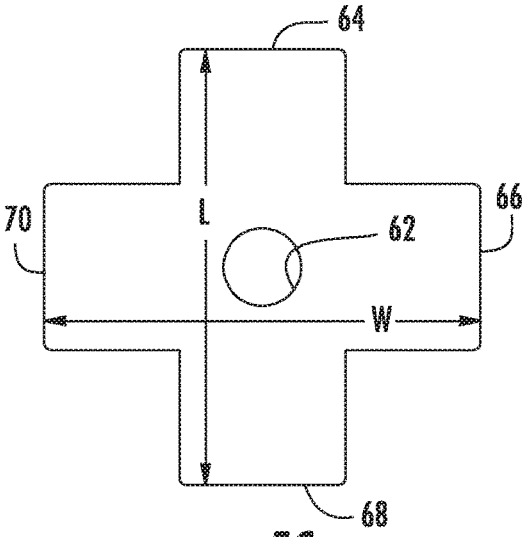
FIG. 5C is a top plan view of another alternative embodiment of a positioning insert.
Figure 5D:
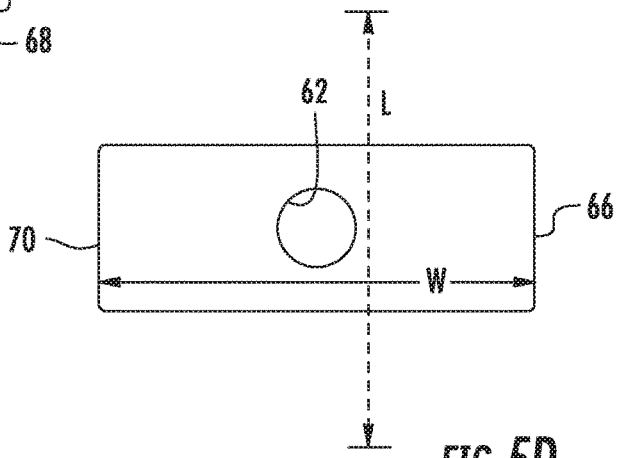
FIG. 5D is a top plan view of yet another alternative embodiment of a positioning insert.

In alternative embodiments shown in FIGS. 5B-5D, various shapes of the positioning insert 60 are contemplated, and the positioning insert may only have one of its length or width that is substantially equal to the length L or width W of the container 10. Regardless of the shape, the positioning insert 50 may be sized to closely fit and frictionally engage two or more of the sidewalls 14-20.

Figure 8A:
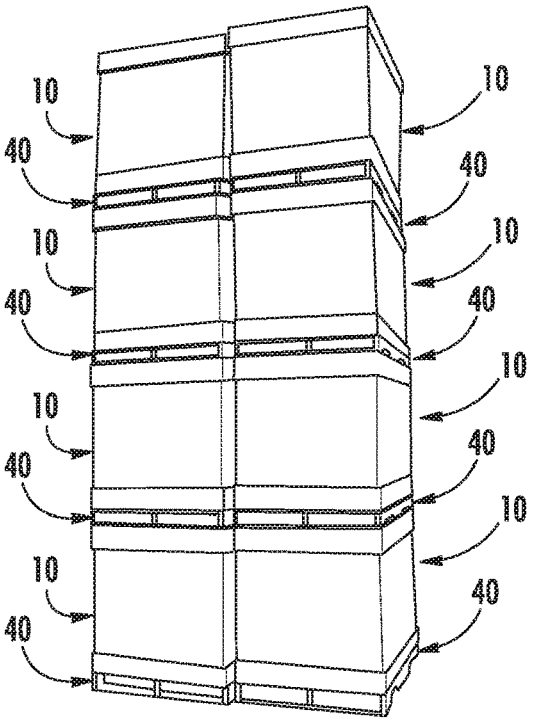
FIG. 8A is a side perspective of a plurality of stacked containers on pallets.
Figure 8B:
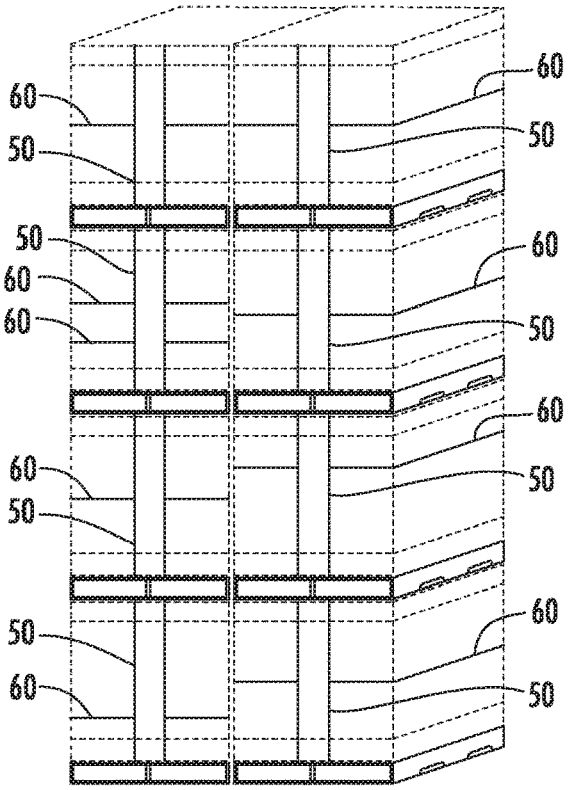
FIG. 8B is a side perspective view of the plurality of stacked containers of FIG. 8A with sidewalls, top walls, and bottom walls of the containers shown in relief.

The positioning insert 60 provides flexibility in configurations of the container 10. For example as shown in FIG. 8B, a positioning insert 60 may be placed at various heights within the container 10. Moreover, a plurality of positioning inserts 60 may be provided along the height of the container 10; each subsequent positioning insert further improves alignment of the core 50 and divides the container 10 into additional compartments.

Figure 6:
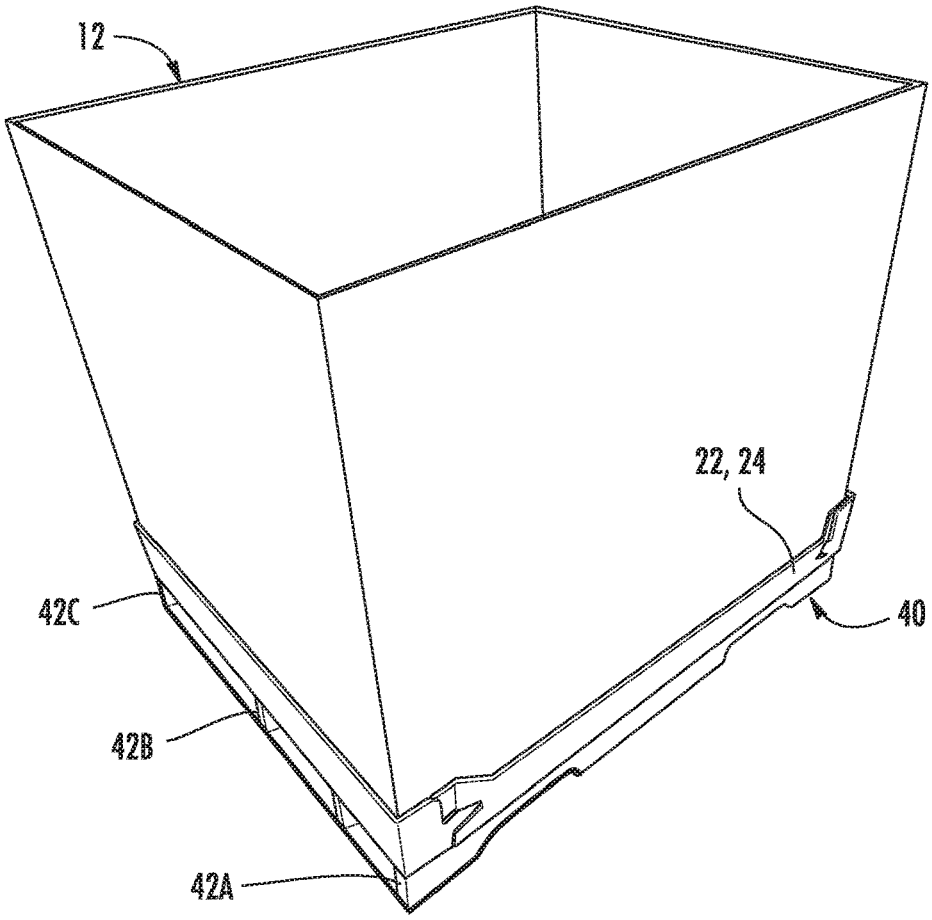
FIG. 6 is a perspective view of the container of FIG. 1 on a pallet with the core and positioning insert removed.
Figure 7:
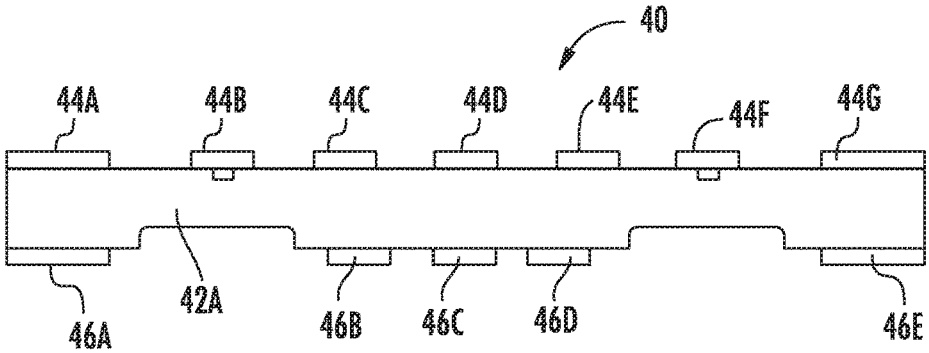
FIG. 7 is a side elevation view of a pallet.

As best shown in FIGS. 6 and 7, a pallet 40 is provided for supporting the container 10 of the present invention. The pallet 40 includes a plurality of runners 42A-C including a center runner 42B. The pallet further includes a plurality of upper boards or ribs 44A-G, including an upper center board 44D, and a plurality of lower boards 46A-E, including a lower center board 46C.

When the container 10 is assembled on the pallet 40 as shown in FIGS. 2, 3, and 6, the core 50 is preferably aligned with the pallet 50 at the upper center board 44D, the center runner 42B, and the lower center board 46C. This arrangement optimizes structural integrity during use, such that vertical loads applied to the core 50 are transferred to the pallet 40. FIG. 8B shows that when multiple containers 10 are stacked, the respective cores 50 are vertically aligned.

When assembled in one embodiment, a wrap (not shown) may be provided to surround the container 10, including the bottom wall 22, top wall 26, and the pallet 40. The wrap may be formed of plastic, for example a stretchable clear plastic or shrink wrap. The wrap may be installed by wrapping a sheet around a perimeter of the container 10 as defined by the side walls 14-20. The wrap functions to prevent shifting of loads, to hold the container 10 on the pallet 40, and to prevent bugs or debris from penetrating the container.

During transport, for example by a forklift or a truck, the container 10 resists collapsing due to shifting loads or lateral forces. The flanges 24 and 28 of the bottom wall 22 and top wall 26 hold the plurality of side walls 14-20 while the positioning insert 60 can serve to prevent the side walls from collapsing inwardly. The positioning insert 60 maintains the core 50 in a vertical position and resists lateral forces by pressing against at least one of the side walls 14-20.

In one exemplary embodiment, the container 10 is used to store and transport trays or containers used in the food industry. Examples of food trays and food containers applicable to the present application are found in U.S. Patent Application Publication No. 2014/0054292 and U.S. Patent Application Publication No. 2017/0165896, the entire disclosures of which are incorporated herein by reference and for all purposes. Such food trays and food containers (or components thereof) are made of, e.g., food-grade plastics, and may be nested or stacked within the container 10. The container 10 of the present application may be used in combination with a plurality of such food trays and food containers, and the container 10 may be shaped and dimensioned to maximize the number of food trays and food containers held therein. In other words, the food trays and food containers may be efficiently and densely packed within the sidewalls 14-20 and about the core 50.

One skilled in the art should recognize that various changes in the container 10 may be implemented. For example, the bottom wall 22 and/or the pallet 40 may include a mounting structure for receiving, aligning, and guiding the core 50 during assembly and use. This mounting structure may be, for example, a socket, a sleeve, a peg (e.g., a short cylinder with a diameter slightly less than the inner diameter ID of the core 50), or a positive interconnection such as a bayonet connection. Likewise, the top wall 26 may include a similar mounting structure for engaging the core. The top wall 26 and/or bottom wall 22 may be convexly curved relative to the interior of the container, so as to encourage load transfer to the core 50 as opposed to the side walls 14-20.

In the illustrated embodiments, the positioning insert 60 fits loosely between the core 50 and the sidewalls 14-20 or frictionally engages at least one of the core 50 and the sidewalls 14-20. Alternatively, various interlocking structures may be utilized for placement of the positioning insert 60. The core 50 may include receiving structure for receiving and positively engaging the positioning insert 60, such as a flange or bracket. Moreover, the positioning insert 60 may have a complementary structure for engaging the receiving structure of the core 50. Similar interlocking structures may be used between the positioning insert 60 and one or more of the sidewalls 14-20.

In an embodiment, the illustrated opening 62 in the positioning insert 60 is positioned centrally relative to the length and the width of the positioning insert 60. As a result the core 50 is positioned centrally relative to the length L and the width W of the container 10. However, the opening 62 and core 50 may be repositioned as desired by a user. Likewise, a plurality of openings 62 and respective cores 50 may be included, providing additional reinforcement.

The material of the container 10 and its constituent parts is preferably cardboard, paperboard, corrugated fiberboard, corrugated plastics, and fluted plastics, although the present disclosure is applicable to containers of various materials including plastics, metals, and combinations thereof. The constituent parts of the container 10 may be made from different materials. Regardless of material choice, the arrangement of the core 50 and positioning insert 60 can allow the sidewalls 14-20 to be of a significantly thinner, lighter weight, and weaker material than that of the core 50.

The container 10 may be used to store any desired goods. As such, goods may be stored next to or around the core 50 and the card 60. The core 50 may act as a spool for O-shaped and disc-like goods (e.g., tires) or wound ductile goods (e.g., wire). However, in the illustrated embodiments, the core 50 functions structurally and is not a spool for goods stored in the container 10.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A container for pallet-based storage and transport, comprising:

a bottom wall defining a length and a width of the container;

a top wall;

a plurality of side walls positioned between the bottom wall and top wall to form an enclosure;

a core extending from adjacent the bottom wall to adjacent the top wall; and a positioning insert configured to center the core along the length and the width of the container, wherein the positioning insert is adjacent at least two side walls of the plurality of side walls, wherein the core is configured to transfer substantially all of a vertical load on the top wall to the bottom wall.

2. The container according to claim 1, wherein at least 90% of a vertical load on the top wall is transferred to the core.

3. The container according to claim 1, wherein the positioning insert abuts at least two side walls of the plurality of side walls.

4. The container according to claim 1, wherein the positioning insert is positioned between the bottom wall and the top wall to divide the container into a top section and a bottom section.

5. The container according to claim 1, wherein the core is substantially the same height as the plurality of side walls.

6. The container according to claim 1, wherein a height of the core is greater than a height of the plurality of side walls.

7. The container according to claim 1, wherein the bottom wall, the top wall, and the plurality of side walls are formed of corrugated fiberboard or cardboard.

8. The container according to claim 1, wherein the core is formed of cardboard.

9. The container according to claim 8, wherein the core is a cylinder with a diameter of about 2 inches to about 5 inches.

10. The container according to claim 8, wherein the core is configured to support up to 3,500 pounds.

11. The container according to claim 1, wherein the container comprises a single core located centrally along the length and the width of the container.

12. The container according to claim 1, wherein the core does not function as a spool for either disc-shaped goods or wound goods.

13. A pallet storage system, comprising a first pallet including a plurality of runners and a plurality of ribs perpendicular to the plurality of runners, the pallet defining a length and a width; and a first container including a bottom, side walls, a top, and a core extending from the bottom to the top, wherein the container has a length and a width approximately equal to the first pallet, wherein the core is centered along the length and the width of the container, such that the core is aligned with a center rib of the plurality of ribs and aligned with a center runner of the plurality of runners.

14. The pallet storage system according to claim 13 further comprising a positioning insert configured to center the core along the length and the width of the container, wherein the positioning insert abuts at least two side walls of the plurality of side walls.

15. The pallet storage system according to claim 13, further comprising at least one additional pallet for stacking on the first container, and when the at least one additional pallet is stacked on the first container, the core transfers substantially all of the weight of the at least one additional pallet to the first pallet.

16. The pallet storage system according to claim 13, wherein the core is configured to support up to 3,500 pounds.

17. The pallet storage system according to claim 13, further comprising at least one additional pallet for stacking on the first container, and the core is configured to support substantially all of a vertical load of the at least one additional pallet.

18. The pallet storage system according to claim 13, further comprising at least one additional pallet for stacking on the first container, and the core is configured to support at least 90% of a vertical load of the at least one additional pallet.

19. A method of storing pallet containers, comprising providing a first container having a first core and a first positioning insert;

providing a first pallet;

mounting the first container on the first pallet;

providing a second container having a second core and a second positioning insert;

providing a second pallet;

mounting the second container on the second pallet;

vertically aligning the first core via the first positioning insert and the second core via the second positioning insert; and stacking the second pallet on the first container such that substantially all of the weight of the second container is supported by the first pallet via the first core.

* * * * *